US005492460A

United States Patent [19]

Takeda et al.

[11] Patent Number: 5,492,460

[45] Date of Patent: Feb. 20, 1996

[54] SCROLL-TYPE FLUID MACHINE HAVING A WEAR-RESISTANT PLATE

[75] Inventors: Kimiharu Takeda; Tetuzou Ukai, both of Aichi; Masumi Sekita, Nagoya, all of Japan

[73] Assignee: Mitsubishi Jukogyo Kabushiki Kaisha, Tokyo, Japan

[21] Appl. No.: 207,189

[22] Filed: Mar. 8, 1994

[30] Foreign Application Priority Data

Aug. 30, 1993 [JP] Japan ..... 5-213992

[51] Int. Cl.[6] ..... F01C 1/04

[52] U.S. Cl. ..... 418/55.2; 418/178

[58] Field of Search ..... 418/55.2, 178

[56] References Cited

FOREIGN PATENT DOCUMENTS

| | | | |
|---|---|---|---|
| 0122067 | 10/1984 | European Pat. Off. | 418/55.2 |
| 55-72680 | 5/1980 | Japan . | |
| 57-99202 | 6/1982 | Japan | 418/55.2 |
| 2125988 | 5/1990 | Japan | 418/55.2 |
| 2146201 | 6/1990 | Japan | 418/55.2 |
| 2-298686 | 12/1990 | Japan . | |
| 3-92590 | 4/1991 | Japan | 418/55.2 |

*Primary Examiner*—John J. Vrablik

*Attorney, Agent, or Firm*—Jacobson, Price, Holman & Stern

[57] ABSTRACT

In a scroll type machine, such as a scroll compressor, the difference in level between the axial end surface of a wear-resistant plate (40) installed at the periphery of the end plate (17) of an orbiting scroll (16) and the axial end surface of the end plate (17) is set within 0±10 μm. This difference in level (δ) is set to this range to prevent wear of the wear-resistant plate and the end plate of the orbiting scroll and to prevent deterioration in the performance of the scroll-type compressor so that a scroll-type compressor with high performance and high reliability can be realized.

2 Claims, 4 Drawing Sheets

α : TUFRAME COATING THICKNESS

β : INCREASE IN DIMENSION

SCROLL-TYPE FLUID MACHINE HAVING A WEAR-RESISTANT PLATE

BACKGROUND OF THE INVENTION

The present invention relates to a scroll-type fluid machine which is constructed by combining an orbiting scroll and a fixed scroll.

Air conditioning units have recently used a scroll-type compressor (scroll-type fluid machine) because of its advantage of efficient compression.

As shown in FIGS. 6 and 7 the scroll-type compressor is constructed so as to have a scroll-type compressor section h which combines a fixed scroll d including a spiral wrap b disposed on an end plate a and a peripheral wall surrounding the wrap b with orbiting scroll g including a spiral wrap f disposed on an end plate e.

Specifically, the compressor section h combines the scrolls d and g so that they engage with each other at a predetermined shifted angle to define enclosed spaces i for producing compression between these wraps.

The volume of the enclosed space i decreases gradually from the peripheral side to the center by revolving the orbiting scroll g around the axis of the fixed scroll d using, for example, a rotating shaft k having an eccentric pin j at its tip. That is to say, the compressor section h compresses a gas by taking advantage of the change in its volume. The orbiting scroll g is provided with a rotation checking mechanism, such as an Oldham's ring, for checking the rotation of the orbiting scroll g, though not shown in the figure.

With such a scroll-type compressor, to prevent gas leakage from the enclosed space i, the fixed scroll d is supported in such a manner as to be displaced in the axial direction, and back pressure chambers m are disposed on the back surface side of the fixed scroll d as shown in FIG. 6, so that the fixed scroll d is pressed against the orbiting scroll g in the axial direction. Alternatively, a back pressure chamber (not shown) is disposed on the back surface side of the orbiting scroll g, so that the orbiting scroll g is inversely pressed against the fixed scroll d in the axial direction.

The scroll-type compressor has a disadvantage that the peripheral portion of the end plate e of the orbiting scroll g and the axial end surface of the peripheral wall c of the fixed scroll d are worn because these portions are pressed against each other during the operation by a force which revolves the orbiting scroll g in the reverse direction.

Therefore, consideration has been made to prevent the wear by embedding a hard, wear-resistant plate n at the periphery of the orbiting scroll g, which is slidingly in contact with the axial end surface of the peripheral wall c of the fixed scroll d, using the techniques disclosed in Japanese Patent Laid-Open No. S55-72680 and Japanese Patent Laid-Open No. H2-298686.

Specifically, as shown in FIG. 8, a continuous, annular groove o is formed in the circumferential direction at the periphery of the orbiting scroll g, which is slidingly in contact with the axial end surface of the peripheral wall c, and a hard, wear-resistant plate n, which is formed into a ring shape, is embedded in the groove o.

This construction, in which the wear-resistant plate n is separately installed, produces a difference in level δ between the axial end surface of the wear-resistant plate n and the axial end surface of the end plate e of the orbiting scroll g as shown in FIG. 8.

It has been found that this difference in level δ reduces the compressibility of the scroll-type compressor or accelerates wear of the wear-resistant plate n and the end plate e.

However, the tolerance which avoids the problem caused by this difference in level δ has not been established; therefore, the problem has not been solved.

BRIEF SUMMARY OF THE INVENTION

The present invention was made in view of the above situation. Accordingly, an object of the present invention is to provide a scroll-type fluid machine which can prevent the deterioration in performance and wear due to the difference in level between the axial end surface of the wear-resistant plate and the axial end surface of the end plate of the orbiting scroll.

To achieve the above object, on the scroll-type fluid machine of this invention a surface is used on the orbiting scroll and the difference in level between the axial end surface of the wear-resistant plate and the axial end surface of the end plate of the orbiting scroll is set within 0±10μm.

According to the scroll-type fluid machine of this invention, experiments have shown that when the difference in δ level is set within 0±10 μm, the wear of the wear-resistant plate and the end plate of the orbiting scroll is prevented, while the deterioration in performance of the scroll-type fluid machine being is prevented.

Thus, a scroll-type fluid machine with high performance and high reliability can be realized.

Thus, according to the invention, the deterioration in performance and the progress in wear due to the difference in level between the axial end surface of the wear-resistant plate and the axial end surface of end plate of the orbiting scroll can be prevented.

Therefore, a less-worn scroll-type fluid machine with high performance and high reliability can be realized.

BRIEF DESCRIPTION OF THE DRAWINGS

The invention will now be described in detail with reference to the accompanying drawings, wherein.

DETAILED DESCRIPTION

An embodiment of the present invention will be described below with reference to FIGS. 1 through 3.

Figure 3:
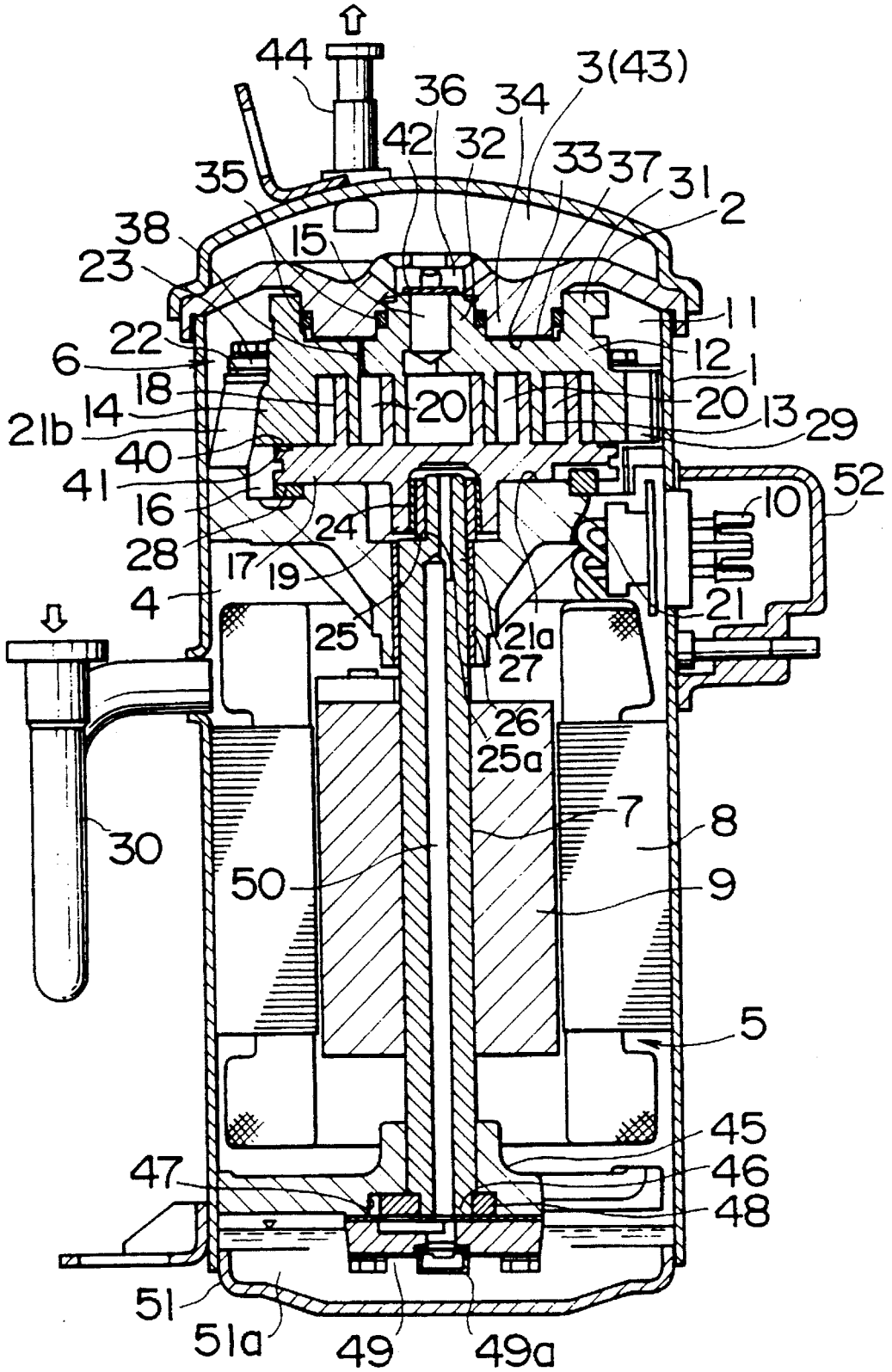
FIG. 3 is a cross-sectional view showing the construction of a scroll-type compressor in which the present invention is embodied.
Figure 5:
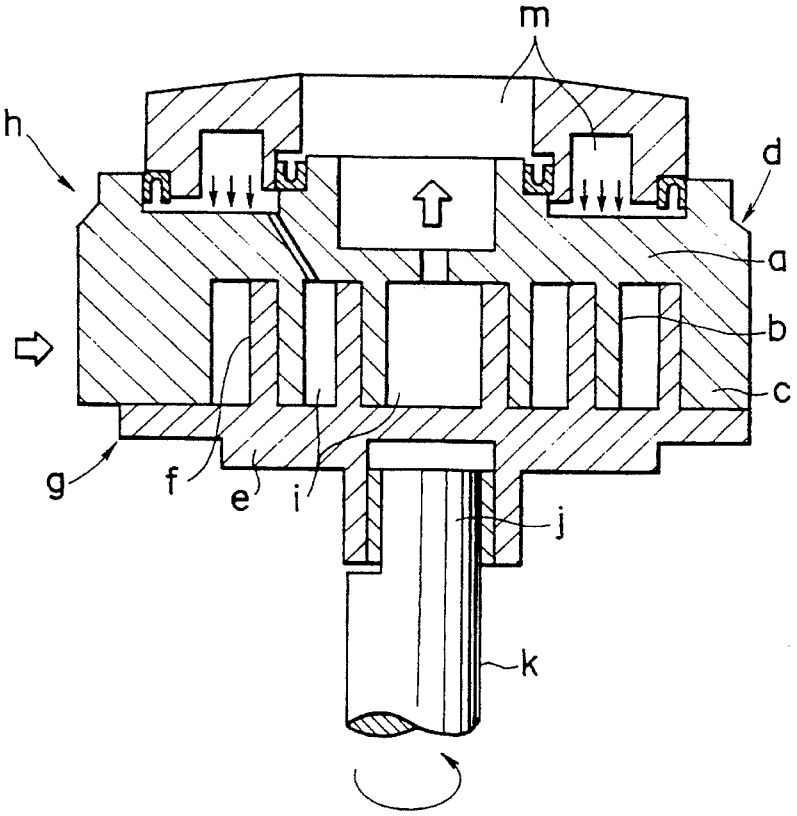
FIG. 5 (PRIOR ART)
FIG. 5 is a cross-sectional view illustrating a conventional scroll-type compressor.
Figure 6:
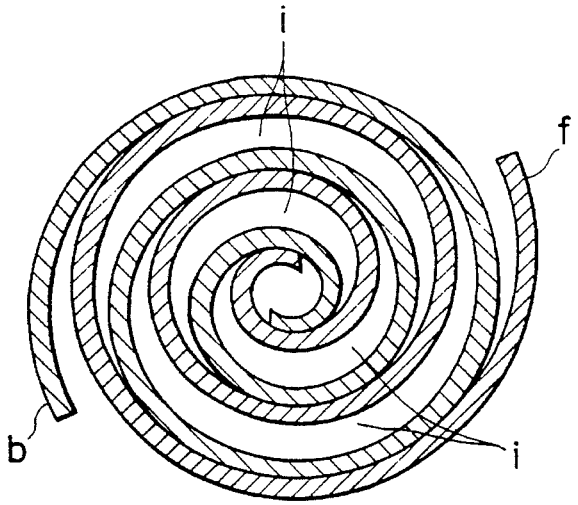
FIG. 6 (PRIOR ART)
FIG. 6 is a cross-sectional view showing the engagement of fixed and orbiting scrolls of the compressor section of the conventional scroll-type compressor.

FIG. 3 shows the construction of a scroll-type compressor (scroll-type fluid machine) to which the present invention is applied. In this figure, reference numeral 1 denotes a closed housing.

The closed housing 1 is formed into a cylindrical shape extending in the vertical direction. On the upper side in the closed housing 1, a discharge cover 2 is installed to partition the interior of the closed housing 1 into an upper high-pressure side 3 and a lower low-pressure side 4.

On the low-pressure side 4 of the closed housing 1, an electric motor 5 is mounted at the lower portion, and a scroll-type compressor section 6 is disposed at the upper portion. Between the lower and upper portions, a rotating shaft 7 is installed.

The electric motor 5 has a stator 8 supported by being pressed into the inner peripheral portion of the closed housing 1 and a rotor 9 disposed in the bore of the stator 8. The rotor 9 is fixed to the lower part of the rotating shaft 7, so that rotation of the rotor 9 rotates by the rotating shaft 7. The terminal 10 connected to the stator 8 is installed at the outer periphery of the closed housing 1.

The scroll-type compressor section 6 has an aluminum fixed scroll 11, for example, made of an aluminum member and an aluminum orbiting scroll 16 engaging with the fixed scroll 11.

The fixed scroll 11 has an end plate 12, a spiral wrap 13 (same as the wrap shown in FIG. 7) disposed on the inner surface of the end plate 12, and a peripheral wall 14 disposed so as to surround the wrap 13. A discharge port 15 is formed at the center of the end plate 12.

The orbiting scroll 16 has an end plate 17 and a spiral wrap 18 (same as the wrap shown in FIG. 7) disposed on the inner surface of the end plate 17. A cylindrical boss 19 is formed at the center of the outer surface of the end plate 17.

Figure 7:
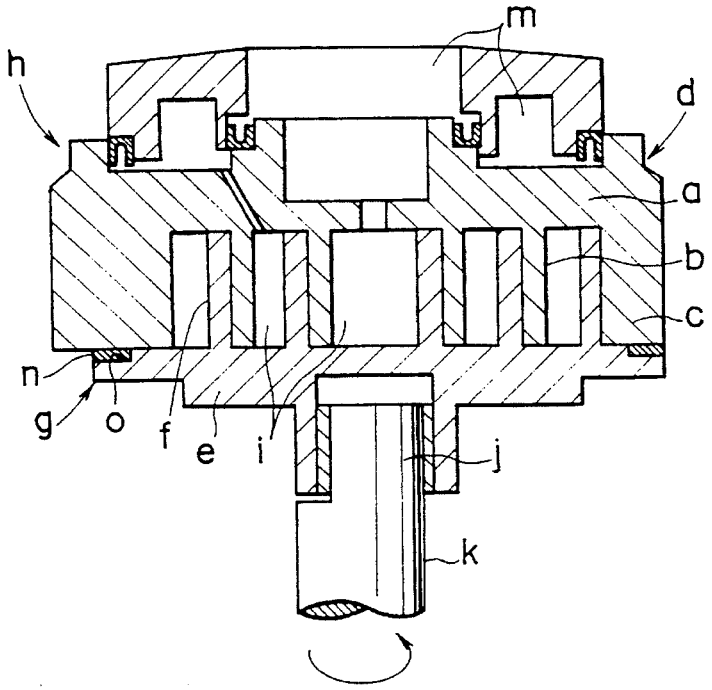
FIG. 7 (PRIOR ART)
FIG. 7 is a cross-sectional view of a compressor section using an orbiting scroll which has a wear-resistant plate at the periphery of the end plate.
Figure 8:
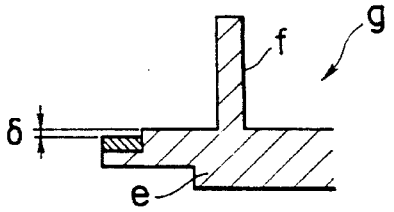
FIG. 8 (PRIOR ART)
FIG. 8 is a cross-sectional view for illustrating a difference in level which is a problem of the conventional.

The fixed scroll 11 and the orbiting scroll 16 are combined with each other so that the wrap 13 engages with the wrap 18 at a shifted angle of 180 degrees (predetermined angle), so that a plurality of crescent-shaped enclosed spaces 20 are formed between the wraps surrounded by the end plates to produce compression (the same as the enclosed spaces shown in FIG. 7).

The combined scrolls 11 and 16 are interposed between the discharge cover 2 and a casing-like main frame 21 fixed at the upper part of the low-pressure side 4 with the fixed scroll 11 disposed on the upper side and the orbiting scroll on the lower side.

The end plate 17 of the orbiting scroll 16 is slidably supported by a horizontal bearing surface 21*a* formed on the upper surface of the main frame 21.

The fixed scroll 11 is supported so as to be displaced vertically with respect to the peripheral wall 21*b* formed at the outer periphery of the main frame 21 via a support spring 22. Specifically, the fixed scroll 11 is provided with a bracket 23 protruding to the side of the peripheral wall 21*b*, and the bracket 23 is fixed to the upper part of the peripheral wall 21*b* via the support spring 22.

A suction port (not shown) formed in the peripheral wall 14 of the fixed scroll 11 communicates with a space 29 at the side of the peripheral wall 14, a suction passage (not shown) which is formed in the main frame 21 and connects both sides of the main frame 21 with each other, and a suction tube 30 connected to the outer periphery of the closed housing 1 through the low-pressure side 4, so that a gas from the outside can be admitted to the compressor section 6.

In the boss 19 of the orbiting scroll 16, a drive bushing 25 is inserted via a rotating bearing 24. This drive bushing 25 has a slide hole 25a formed of a through hole extending to some extent in the radial direction.

The upper end of the rotating shaft 7 passes through the main frame 21 and extends toward the center of the end plate of the orbiting scroll 16. The upper end of the rotating shaft 7 is rotatably supported by an upper bearing 26 installed at the pierced portion of the main frame 21. At the upper end of the rotating shaft 7, an eccentric pin 27 is projected. This eccentric pin 27 is slidably inserted into the slide hole 25a. Therefore, the orbiting scroll 16 revolves around the axis of the fixed scroll 11 as the rotating shaft 7 rotates.

Between the end surface 17 of the orbiting scroll 16 and the bearing surface 21*a* of the main frame 21, a rotation checking mechanism, e.g. the Oldham's ring, 28 is interposed, which mechanism allows the revolution of the orbiting scroll 16, but checks the rotation thereof.

By the revolution provided by the Oldham's ring 28 and the eccentric pin 27, the volume of the enclosed space 20 is decreased gradually. Thus, a gas can be compressed by using this enclosed space 20.

On the top of the end plate 12 of the fixed scroll 11, two cylindrical flanges 31 and 32, large and small, project upward with their center being aligned with the axis of the end plate 12.

On the inner surface of the discharge cover 2 is formed a cylindrical flange 34 which projects toward the annular concave 33 formed between the flanges 31 and 32. This flange 34 is slidably inserted in the concave 33. Between the side surfaces where the flange 34 slides with respect to the flanges 31 and 32, respective annular sealing members 35 are interposed to seal this portion.

Thus, a high-pressure chamber 36 is formed in the central region partitioned by the inner sealing member 35, that is, at the central portion on the top of the end plate 12 covered by the central portion of the discharge cover 2. Also, an intermediate-pressure chamber 37 is formed in the intermediate region partitioned by the outer sealing member 35, that is, at the intermediate portion on the top of the end plate 12 covered by the intermediate portion of the discharge cover 2. Further, a low-pressure chamber, which uses the space 29 and has the same pressure as the suction pressure, is formed.

Among the high-pressure chamber 36, the intermediate-pressure chamber 37, and the low-pressure chamber arranged concentrically with respect to the end plate 12, the high-pressure chamber 36 communicates with the discharge port 15. The intermediate-pressure chamber 37 communicates with the enclosed space 20 under compression through a pressure guiding hole 38 disposed in the end plate 12. By the high-pressure and low-pressure gases admitted into the high-pressure chamber 36 and the intermediate-pressure chamber 37, respectively, the fixed scroll 11 floating upward is pressed against the orbiting scroll 16 in the axial direction.

Figure 1:
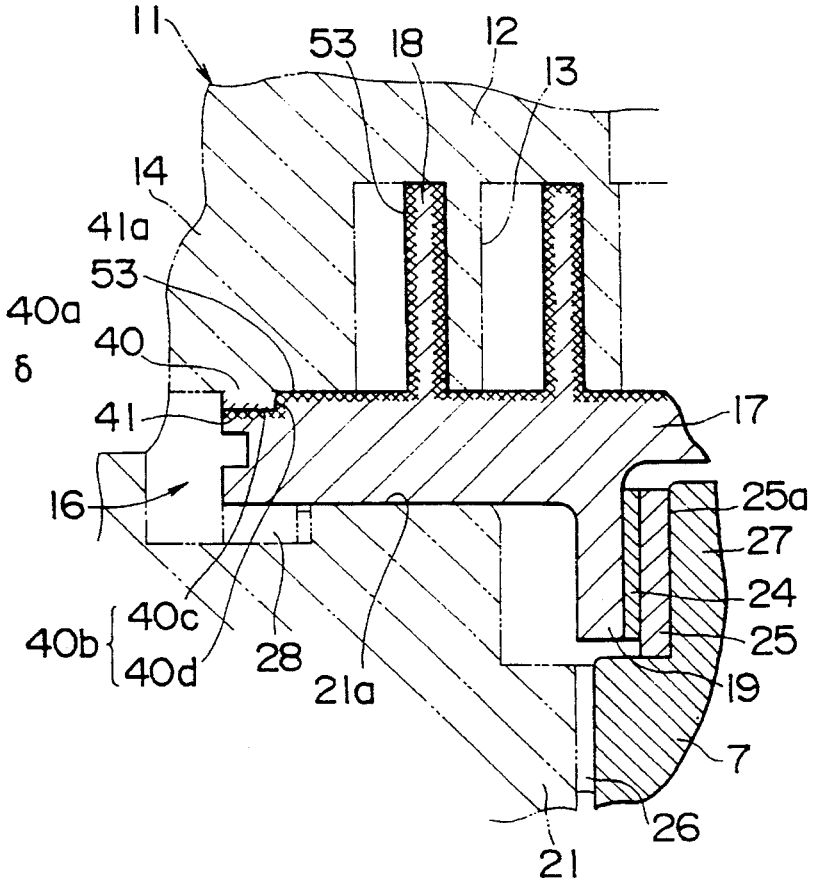
FIG. 1 is a cross-sectional view showing a difference in level between a wear-resistant plate installed on the end plate of an orbiting scroll and the inner surface of the end plate thereof, which is the main portion of the embodiment of the present invention.
Figure 2:
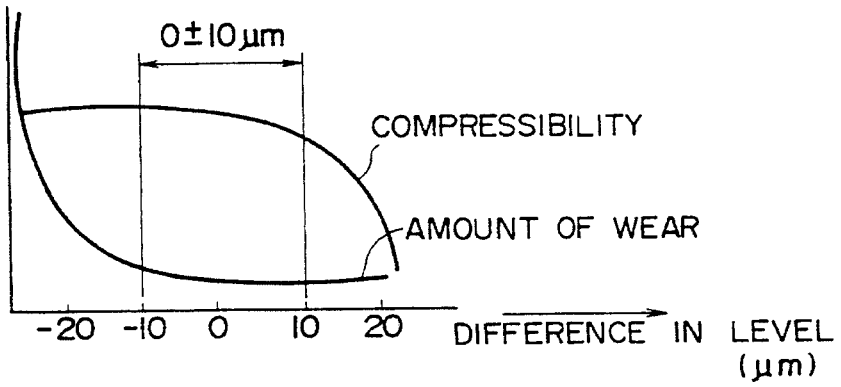
FIG. 2 is a diagram for illustrating the change in performance and amount of wear as a function of difference in level.

On the orbiting scroll 16, a hard, wear-resistant plate 40 formed into a ring shape is disposed at the peripheral portion which is slidingly in contact with the axial end surface of the peripheral wall 14 of the fixed scroll 11, as shown in FIG. 1.

To position the wear-resistant plate 40, a circumferentially continuous, annular groove 41 is provided at the peripheral portion of the end plate 17 of the orbiting scroll 16 which is slidingly in contact with the axial end surface of the peripheral wall 14, and the wear-resistant plate 40 is embedded in this groove 41, as shown in Fig.1.

This wear-resistant plate 40 prevents wear caused by a force which is generated during operation to revolve the orbiting scroll 16 in the reverse direction.

As shown in FIG. 1, the difference in level δ between the upper surface (axial end surface) of the exposed wear-resistant plate 40 and the inner surface (axial end surface) of the end plate 17 of the orbiting scroll 16 is set within 0±10 μm.

A check valve 42 for preventing back flow is installed in the discharge port 15. The discharge port 15 communicates with a discharge chamber 43 which is defined by a space forming the high-pressure side 3. The discharge chamber 43 communicates with a discharge tube 44 connected to the upper wall of the closed housing 1, so that the gas discharged into the discharge chamber 43 can be expelled to the outside of the closed housing 1.

The lower part of the rotating shaft 7 extends toward the inner bottom of the closed housing 1. The lower part is rotatably supported by a lower bearing 45 mounted at the lower portion of the low-pressure side 4.

An oil pump 49 is installed at the lower part of the rotating shaft 7. This oil pump 49 uses a force feed mechanism in which pumping action is produced by rotating, for example, an eccentric shaft 46 and by oscillating a rotary ring 48 housed in a cylinder 47. The suction portion (not shown) of the oil pump 49 communicates with an oil reservoir 51 formed in the inner bottom of the closed housing 1, so that oil 51*a* collected in the oil reservoir 51 is sucked. The discharge portion of the oil pump 49 communicates with the sliding portions of the compressor section 6 through an oil passage 50 formed in the rotating shaft 7, so that the oil 51*a* in the oil reservoir 51 can be forcedly fed to places where lubrication is required.

At the discharge portion of the oil pump 49, a relief valve 49*a* is installed to return the oil 51*a* to the oil reservoir 51 when a predetermined pressure is exceeded.

Reference numeral 52 denotes a terminal cover for covering the terminal 10 exposed to the outside of the closed housing 1.

Next, the operation of the scroll-type compressor thus constructed will be described.

When the electric motor 5 is energized through the terminal 10, the rotor 9 rotates.

This rotation is transmitted to the oil pump 49 through the rotating shaft 7.

Then, the eccentric shaft 46 of the oil pump 49 is eccentrically rotated, so that the rotary ring 48 is oscillated.

Thus, the oil 51*a* in the oil reservoir 51 is sucked from the suction portion of the oil pump 49, and discharged from the discharge portion. The discharged oil 51*a* is forcedly fed, through the oil passage 50, to the sliding portion of the compressor section 6 and other places requiring the oil 51*a*.

On the other hand, the rotation of the electric motor 5 is transmitted to the orbiting scroll 16 via the rotating shaft 7, the eccentric pin 27, and the boss 19.

Since the rotation of the orbiting scroll 16 is checked by the Oldham's ring 28, the whole of the orbiting scroll does not rotate, but revolves in a circular orbit of a revolution radius with the center aligned with the axis of the fixed scroll 11.

As this revolution proceeds, the volume of the enclosed space formed between the fixed scroll 11 and the orbiting scroll 16 is changed in a decreasing manner.

The suction gas is introduced into the outermost peripheral region of the wraps 13 and 18 by passing through the suction tube 30, the low-pressure side 4, a suction passage (not shown), and a suction port (not shown) in that order, and fed from the region to the enclosed space 20.

The sucked gas reaches the central portion while being compressed gradually as the volume of the enclosed space 20 is decreased by the revolution of the orbiting scroll 16.

At this time, the fixed scroll 11 is pressed against the orbiting scroll 16 by the discharge pressure fed to the high-pressure chamber 36 and the intermediate pressure fed to the intermediate-pressure chamber 37, so that the compression process in the enclosed space 20 takes place while preventing the leakage of gas.

The gas compressed to a predetermined pressure is discharged from the discharge port 15 to the outside of the closed housing 1 through the check valve 42, the discharge chamber 43, and the discharge tube 44.

During the operation, the wear of the peripheral wall 14 of the fixed scroll 11 and the end plate 17 of the orbiting scroll 16, which is caused by a force which revolves the orbiting scroll 16 in the reverse direction, is prevented by the wear-resistant plate 40 disposed at the periphery of the end plate 17.

In this case, if the wear-resistant plate 40 is provided as a separate body, the difference of level δ between the upper surface of the wear-resistant plate 40 and the upper surface of the end plate of the orbiting scroll 16 will have a common difference depending on irregularities of manufacture of all relative parts. It is found that, due to these irregularities of level difference δ, the function of the scroll-type compressor is deteriorated or its wear increases markedly. At the same time, in case the surface of the orbiting scroll is treated, its irregularity is also sure to become a cause of making said level difference δ large.

Specifically, the surface treatment, which is done on the orbiting scroll 16 side to prevent wear caused by the sliding contact with the wrap end surface, is also used throughout the installation surface 40*b* on which the wear-resistant plate 40 is installed.

This construction will be described in detail below. On the orbiting scroll 16 made of aluminum, as the surface treatment of the tooth bottom surface, for example, the TUFRAM processing is done on the inner surface of the end plate 17 and the side surfaces of the wrap 18.

In the TUFRAM processing, anodic oxidation coating is produced on the aluminum base material, and the pores produced in this process are impregnated with Teflon.

Figure 4:
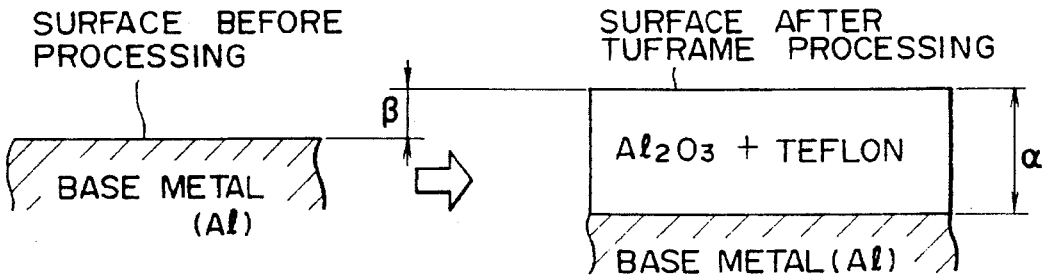
FIG. 4 is a schematic diagram illustrating a wide variation in difference in level caused by surface treatment.

Like other methods of surface treatment, the TUFRAM processing changes the thickness of the processed surface as shown in FIG. 4.

In the TUFRAM processing, the volume is increased by the coating thickness α (See FIG. 4) as compared with the volume before the processing by the reaction of $2Al+3O \rightarrow Al_2O_2$ which takes place in the process in which anodic oxidation coating is produced.

The increase in volume varies with the variation in coating thickness α of surface treatment, as with the case of other surface treatment methods.

The difference in level δ is varied by the variation in coating thickness α to an extent such as to be uncontrollable; as a result, the performance of a scroll-type compressor is deteriorated or the wear proceeds remarkably as described above. The tolerance for solving this problem has not been established.

There is no tolerance established to solve this problem; therefore, the applicants attempted many techniques.

The applicants found that the scroll-type compressor offers high performance, and at the same time the progress of wear of the peripheral wall 14 and the wear-resistant plate 40 can be kept at the lowest level, under the following two conditions: the surface treatment, namely, "TUFRAM" treatment is extended not only to the tooth base of the orbiting scroll 16 but also to the whole of the installation surface 40*b* where the wear-resistant plate 40 is disposed; and the difference in level is set within 0±10 μm (tolerance) as described above.

The relationship between the performance of a scroll-type compressor and the amount of wear was plotted with the former as ordinate and the latter as abscissa. As a result, as shown in the diagram of FIG. 2, the amount of wear increases when the difference in level δ exceeds 10 μm. If the difference in level δ exceeds 20 μm, the end plate 17 of the orbiting scroll 16 is inclined with respect to the axial end surface of the peripheral wall 14 (fixed scroll 11) so that the edge 41*a* of the groove 41 and the peripheral edge 40*a* of the wear-resistant plate 40 are brought into contact with the axial end surface of the peripheral wall 14, resulting in the progress of wear. If a difference in level δ is formed in the reverse direction, the difference in level exceeding −10 μm widens the gap between the wrap end and the inner surface of the end plate, so that the compressibility of gas in the enclosed space 20 is impaired. Particularly when the difference in level δ reaches −20 μm, the performance of a scroll-type compressor is remarkably deteriorated.

Therefore, by setting the difference in level δ within 0± 10 μm, the problems of deteriorated compressibility and progress of wear of the wear-resistant plate 40, which are caused by the difference in level δ, can be overcome rapidly and reliably.

The TUFRAM processing may be used not only on the tooth bottom surface of the orbiting scroll 16 but also on the whole of the installation surface 40*b* on which the wear-resistant plate 40 is installed, that is, on the horizontal surface 40*c* forming the installation surface 40*b* and the vertical surface 40*d* rising from the horizontal surface 40*c*. Reference numeral 53 denotes the surface treatment layer thus applied.

In the second embodiment, the TUFRAM processing was used on the orbiting scroll 16 made of aluminum as surface treatment. However, the surface treatment is not limited to the TUFRAM processing, but other surface treatment methods such as alumite processing achieve the same effect.

The present invention was applied to the scroll-type compressor in the embodiments described. However, the application is not limited to the scroll-type compressor, but the present invention can be applied to other scroll-type fluid machines.

We claim:

1. A scroll-type fluid machine comprising:

a fixed scroll having an end plate, a spiral wrap on said end plate, side surfaces on said spiral wrap a peripheral wall surrounding said spiral wrap and an axial end surface on said peripheral wall;

an orbiting scroll having an end plate, a spiral wrap on said end plate of said orbiting scroll and having side surfaces engaging with said side surfaces on said spiral wrap on said fixed scroll, one of said scrolls being axially pressed against the other of said scrolls, and an axial end surface on said end plate of said orbiting scroll and having a peripheral portion;

a surface treatment on said orbiting scroll comprising a coating on at least said side surfaces of said spiral wrap on said orbiting scroll and said axial end surface of said end plate on said orbiting scroll, said coating being selected from the group consisting of an anodic oxidation coating with the pores thereof impregnated with "TEFLON", and alumite treatment;

a separate hard, wear-resistant plate mounted at least on said peripheral portion of said axial end surface of said end plate on said orbiting scroll, said axial end surface of said end plate on said orbiting scroll being at least partly in sliding contact with said axial end surface on said peripheral wall;

an axial end surface on said wear-resistant plate facing said axial end surface on said peripheral wall; and a surface treatment comprising a coating on said peripheral portion of said axial end surface on said end plate of said orbiting scroll where said wear-resistant plate is mounted, so that there is a difference in level within 0±10 μm between said axial end surface of said wear-resistant plate and said axial end surface of said end plate of said orbiting scroll.

2. The scroll-type fluid machine as claimed in claim 1 and further comprising:

a groove on said peripheral portion of said axial end surface on said end plate of said orbiting scroll where said wear-resistant plate is mounted, said groove having a depth corresponding to the thickness of said wear-resisting plate, said wear-resistant plate being mounted in said groove; and said surface treatment on said peripheral portion of said axially end surface on said end plate of said orbiting scroll also being on said groove where said wear-resistant plate is mounted, and comprises a coating selected from the group consisting of an anodic oxidation coating with the pores thereof impregnated with "TEFLON" and alumite treatment.

* * * * *